United States Patent [19]

Evers

[11] 4,311,287

[45] Jan. 19, 1982

[54] WEB PAY-OUT ASSEMBLY

[75] Inventor: Jack R. Evers, Los Angeles, Calif.

[73] Assignee: Developak Corporation, Redondo Beach, Calif.

[21] Appl. No.: 76,454

[22] Filed: Sep. 17, 1979

[51] Int. Cl.[3] ..... B65H 75/24

[52] U.S. Cl. ..... 242/68.3; 242/72.1

[58] Field of Search ..... 242/68.3, 72.1, 72 R, 242/68, 68.1, 68.2; 279/2 R; 269/48.1

[56] References Cited

U.S. PATENT DOCUMENTS

| | | | |
|---|---|---|---|
| 2,443,243 | 6/1948 | Hayssen | 242/72.1 |
| 2,959,371 | 11/1960 | Melton | 242/68.3 X |
| 3,052,420 | 9/1962 | Roberts | 242/72.1 X |
| 3,312,411 | 4/1967 | Mertens | 242/68.3 |
| 3,322,365 | 5/1967 | Martin et al. | 242/68.3 |
| 3,837,591 | 9/1974 | Clarke | 242/72.1 X |
| 3,959,822 | 5/1976 | Platt | 242/68.3 X |
| 4,141,517 | 2/1979 | Olcer | 242/68.3 |
| 4,183,475 | 1/1980 | Martija | 242/68.3 |

*Primary Examiner*—John M. Jillions

*Attorney, Agent, or Firm*—Charles E. Brown

[57] ABSTRACT

This relates to a web pay-out assembly wherein a web in spool form is mounted on a hub for selective paying out of the web. The hub is of a hollow construction and includes an internal chamber. A plurality of radiating pins project into the chamber and are projectable radially outwardly beyond the hub for engaging a tubular core of the spool to lock the spool in place on the hub. The pins are resiliently urged inwardly and are cammed outwardly by a nut member threaded onto a positioning member. The hub has opposite flanges and one of the flanges has a tubular extension which is mounted on a control shaft of a control unit. The control unit supports the hub and is mounted on a combined partition and support wall of a machine. The control unit has a mounting flange which is mounted in sealed relation with respect to a tubular spacer and the control unit passes through an opening in the wall so as to be primarily disposed on the opposite side of the wall. Two of the hubs may be mounted in adjacent out-of-aligned relation by providing spacers of different lengths so as to space the hubs differently from the wall.

10 Claims, 3 Drawing Figures

WEB PAY-OUT ASSEMBLY

This invention relates in general to new and useful improvements in web pay-out assemblies, and more specifically to a web pay-out assembly wherein a web carried by a spool may be quickly mounted on a hub and wherein the hub is carried by a control unit which is readily mounted on a combined partition and support wall.

The hub has means for quickly anchoring and releasing a tubular core of a spool mounted thereon. The hub is hollow and has an internal chamber into which a plurality of spool retaining pins extend. Within the chamber is a cam assembly which, when adjusted, urges the pins outwardly so as to protrude into the core of the spool.

The hub has at one end a flange which serves to mount the hub on a control shaft of a control unit. The hub is thus carried by the control shaft for controlled rotation.

In accordance with this invention there is provided novel means for mounting the control unit which supports the hub so that the control unit may extend through an opening in the wall and at the same time may be sealed relative thereto.

With the above, and other objects in view that will hereinafter appear, the nature of the invention will be more clearly understood by reference to the following detailed description, the appended claims and the several views illustrated in the accompanying drawings.

Figures 1, 2, 3:
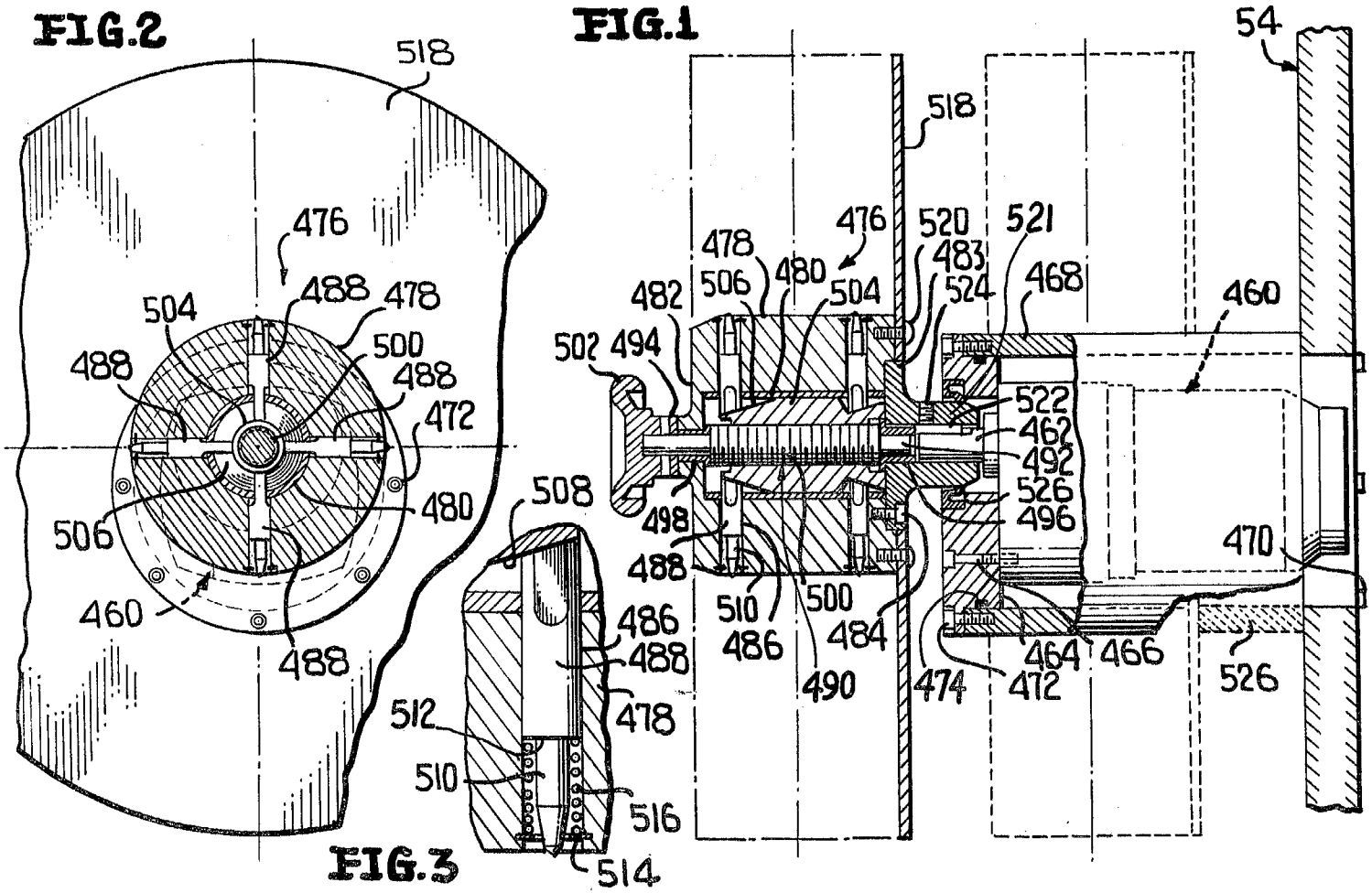
FIG. 1 is an elevational view with parts broken away and shown in section of a web pay-out assembly in accordance with this invention.
FIG. 2 is a fragmentary vertical sectional view taken generally along the line 2—2 of FIG. 1 and shows further the details of the hub and the spool retaining pins.
FIG. 3 is an enlarged fragmentary sectional view taken generally along the line 3—3 of FIG. 1 and shows specifically the resilient mounting of one of the pins.

Referring now to the drawings in detail, it will be seen that the combined partition and mounting wall 54 supports the hub assembly. Further, the hub assembly is carried by a control unit which is generally identified by the numeral 460. The control unit 460 is in the form of an electric motor which is suitably controllable so as to suitably control the pay-out of a web carried by the hub assembly.

The control unit, which is preferably of an electrical type, in of itself is not a part of the invention and it is therefore not specifically described. However, the control unit 460 includes a control shaft 462 which projects from one end thereof. Further, the control unit 460 is carried by a mounting flange 464 to which it is secured by means of bolts 466. The mounting flange 464 is of a stepped configuration and is partially seated in and partially seated on a spacer 468 which is secured to one face of the wall 54 by bolts 470. The mounting flange 464 is secured to the spacer 468 by bolts 472. The mounting flange 464 is sealed relative to the spacer 468 by a sealing ring 474 so as to seal the opening in the wall 54 through which the control unit 460 extends. Thus the right hand side of the wall 54 may define a machinery portion of the machine and the left hand side of the wall 54 may define a sanitary portion. The control device 460 is primarily positioned within the machinery portion.

A hub assembly, generally identified by the numeral 476 is carried by the control shaft 462. The hub assembly 476 includes a hollow hub 478 having a chamber 480 formed therein. One end of the chamber 480 is closed by an integral flange 482 while the opposite end of the chamber 480 is closed by a separately formed flange 483 which is removably secured to one end of the hub 478 by bolts 484 so as to provide access to the interior of chamber 480.

The hub 478 is provided with two sets of circumferentially spaced radiating bores 486, the sets of bores being axially spaced. The bores 486 extend entirely through the hub 478 and have mounted therein for radial outward projection spool retaining pins 488. The pins 488 project into the chamber 480.

In the chamber 480 there is a positioning member 490 which has reduced end portions 492 and 494 extending into the flanges 483 and 482, respectively, and journalled in bushings 496 and 498. The positioning member 490 has an enlarged, externally threaded central portion 500 which has the opposite ends thereof in abutment with the bushings 496, 498 to axially position the positioning member 490.

The end portion 494 extends axially outwardly beyond the flange 482 and has mounted thereon a hand grip member 502 for rotating the positioning member 490 for a purpose to be described hereinafter.

A nut 504, which is internally threaded, is threaded on the central portion 500 of the positioning member 490. The nut 504 has two tapered surfaces 506, 508 which engage the inner ends of the two sets of pins 488 and function as cam surfaces. It will be seen that when the nut 504 is axially shifted to the left by rotating the positioning member 490, the cam surfaces 506, 508 will react on the pins 488 and urge the pins radially outwardly into wedged engagement with the core of a spool (not shown) mounted on the hub. In this manner the spool is locked on the hub in a way in which it may be quickly released.

Referring now to FIG. 3 in particular, it will be seen that each of the pins 488 has an outer portion 510 of a reduced cross section thereby defining a radially outwardly facing shoulder 512. Further, the outer end of each of the bores 486 is closed by a removable stop member 514. A coil spring 516 surrounds the end portion 510 and abuts against the shoulder 512 and the stop member 514 and resists the outward movement of the pins 488. When the nut 504 is shifted to the right, the spring serves to force the pins radially inwardly to their inoperative positions.

It is also to be noted that the hub 478 carries a backing plate 518 which is secured thereto by means of suitable fasteners 520. The spool is shoved against the backing plate and it is automatically aligned thereby.

At this time it is to be noted that the flange 483 has a tubular extension 521. The tubular extension 521 is telescoped over the control shaft 462 and is locked thereto for rotation therewith by means of a key 522. Further, the hub extension 521 is axially fixed on the control shaft 462 by means of suitable set screws 524.

The mounting flange 464 carries a sealing ring 526 which engages the outer periphery of the hub extension 521 to form a seal therewith thereby excluding foreign matter passing from the machinery side of the wall 54 to the sanitary side thereof.

It is also to be noted from FIG. 1 that there is a second hub assembly 476 which is spaced closer to the wall 54 than the above described hub assembly. The second hub assembly 476 is identical to the first hub assembly with the exception to the fact that it is mounted on the wall 54 by a spacer 526 of a different thickness or length than the spacer 468. The mounting of the second hub assembly is identical to that of the first except for this and the fact that it is in adjacent out-of-aligned relation to the first hub assembly.

By providing the two different length spacers, it will be seen that the two hub assemblies may mount two web spools for paying out of the web in adjacent parallel relation.

Although only a preferred embodiment of the invention has been specifically illustrated and described herein, it is to be understood that minor variations may be made in the web pay-out assembly without departing from the spirit and scope of the invention as defined by the appended claims.

I claim:

1. A web pay-out assembly comprising a hub for receiving a spool having a tubular core, said hub being hollow to define an interior chamber and having radial bores extending therethrough in circumferentially spaced relation, spool anchoring pins in said bores and having inner ends extending into said hub chamber, resilient means resisting radial outward movement of said pins, and cam means within said hub chamber and engaging said pin inner ends for forcing outer ends of said pins outwardly beyond said hub to engage a spool case, said cam means including a nut having a tapered external cam surface aligned with said pins, and a threaded positioning member axially fixed within said hub chamber and being rotatable to axially shift said nut to radially position said pins, said hub having flanges at opposite ends axially closing said hub chamber, and said positioning member having end portions rotatably journalled in said flanges, said flanges forming abutment means engageable with a central portion of said positioning member with said positioning member axially reacting against said flanges to effect said axial fixing of said positioning member.

2. A web pay-out assembly comprising a hub for receiving a spool having a tubular core, said hub being hollow to define an interior chamber and having radial bores extending therethrough in circumferentially spaced relation, spool anchoring pins in said bores and having inner ends extending into said hub chamber, resilient means resisting radial outward movement of said pins, and cam means within said hub chamber and engaging said pin inner ends for forcing outer ends of said pins outwardly beyond said hub to engage a spool case, said cam means including a nut having a tapered external cam surface aligned with said pins, and a threaded positioning member axially fixed within said hub chamber and being rotatable to axially shift said nut to radially position said pins, said hub having flanges at opposite ends axially closing said hub chamber, and said positioning member having portions rotatably journalled in said flanges, one of said flanges having a tubular extension for receiving a support shaft for said hub.

3. A web pay-out assembly comprising a hub for receiving a spool having a tubular core, said hub being hollow to define an interior chamber and having radial bores extending therethrough in circumferentially spaced relation, spool anchoring pins in said bores and having inner ends extending into said hub chamber, resilient means resisting radial outward movement of said pins, and cam means within said hub chamber and engaging said pin inner ends for forcing outer ends of said pins outwardly beyond said hub to engage a spool case, a combined partition and support wall, a spacer secured to one surface of said wall in surrounding relation relative to an opening through said wall, a control unit within said spacer and having a fixed mounting flange carried by said spacer remote from said wall in sealed relation thereto and to said wall, said control unit having a control shaft for rotating said hub, said control shaft projecting from said spacer remote from said wall and in a direction away from said wall and means releaseably securing said hub to said control shaft remote from said wall and said spacer for rotation with said control shaft.

4. The assembly of claim 3 wherein said hub has a tubular extension receiving said control shaft, said tubular extension extending into said mounting flange, and a seal betweeen said extension and said mounting flange.

5. The assembly of claim 3 wherein there are two of said assemblies with the hubs thereof being spaced differently from said wall and said assemblies being adjacent out-of-aligned relation, and spacers of said assemblies being of different lengths to facilitate said differential spacing.

6. The assembly of claim 3 wherein said control unit extends through said opening in said wall.

7. A web pay-out assembly comprising a hub for receiving a spool having a tubular case, a combined partition and support wall, a tubular spacer secured to one surface of said wall in surrounding relation relative to an opening through said wall, a control unit for rotating said hub, said control unit being at least partially disposed within said tubular spacer and having a fixed mounting flange carried by said spacer remote from said wall in sealed relation thereto and to said wall, said control unit having a control shaft, said control shaft projecting from said spacer remote from said wall and in a direction away from said wall, and means releaseably securing said hub to said control shaft for rotation therewith.

8. The assembly of claim 7 wherein said hub has a tubular extension receiving said control shaft, said tubular extension extending into said mounting flange, and a seal between said extension and said mounting flange.

9. The assembly of claim 7 wherein there are two of said assemblies with the hubs thereof being spaced differently from said wall and said assemblies being in adjacent out-of-aligned relation, and spacers of said assemblies being of different lengths to facilitate said differential spacing.

10. The assembly of claim 7 wherein said control unit has a rear portion remote from said control shaft, and said rear portion extends through said opening in said wall.

* * * * *